US008447200B2

(12) United States Patent
Paik et al.

(10) Patent No.: US 8,447,200 B2
(45) Date of Patent: May 21, 2013

(54) FUSING DEVICE, IMAGE FORMING APPARATUS HAVING THE SAME, AND CONTROL METHOD THEREOF

(75) Inventors: Sok Won Paik, Jeonju-si (KR); An Sik Jeong, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 341 days.

(21) Appl. No.: 12/975,746

(22) Filed: Dec. 22, 2010

(65) Prior Publication Data

US 2011/0158672 A1 Jun. 30, 2011

(30) Foreign Application Priority Data

Dec. 24, 2009 (KR) ..... 10-2009-130752

(51) Int. Cl.
*G03G 15/20* (2006.01)

(52) U.S. Cl.
USPC ..... 399/70; 219/619

(58) Field of Classification Search
USPC 399/38, 67–70, 122, 320, 328–334; 219/216, 219/619
See application file for complete search history.

(56) References Cited

U.S. PATENT DOCUMENTS

| | | | | |
|---|---|---|---|---|
| 6,301,454 | B1 * | 10/2001 | Nishida et al. | 399/69 |
| 7,683,297 | B2 * | 3/2010 | Kishi et al. | 219/619 |
| 7,840,161 | B2 * | 11/2010 | Namisaki et al. | 399/122 |
| 7,885,571 | B2 * | 2/2011 | Omura | 399/88 |
| 2009/0196643 | A1 | 8/2009 | Mito et al. | |

FOREIGN PATENT DOCUMENTS

| | | |
|---|---|---|
| JP | 2002-184554 | 6/2002 |

* cited by examiner

*Primary Examiner* — Hoan Tran
(74) *Attorney, Agent, or Firm* — Stanzione & Kim, LLP

(57) ABSTRACT

An induction heating type fusing device to reduce the size of an induction coil and an image forming apparatus having the same, and a control method thereof. The image forming apparatus includes a printing device to form an image on a recording medium, and a fusing device to fix the image to the recording medium. The fusing device includes a heating member arranged to transfer heat to the recording medium and having a main heater and a sub heater, and an induction coil having a width equal to or less than a width of the recording medium and arranged in an axial direction of the heating member to generate a magnetic field acting on the main heater. The sub heater is arranged inside the heating member to heat both ends of the main heater.

12 Claims, 7 Drawing Sheets

FUSING DEVICE, IMAGE FORMING APPARATUS HAVING THE SAME, AND CONTROL METHOD THEREOF

CROSS-REFERENCE TO RELATED APPLICATIONS

This application claims priority under 35 U.S.C. §119(a) from Korean Patent Application No. 2009-0130752, filed on Dec. 24, 2009 in the Korean Intellectual Property Office, the disclosure of which is incorporated herein by reference in its entirety.

BACKGROUND

1. Field of the Invention

Embodiments of the present general inventive concept relate to a fusing device using induction heating, an image forming apparatus having the same, and a control method thereof.

2. Description of the Related Art

Image forming apparatuses are devised to form an image on a recording medium. Examples of image forming apparatuses include printers, copiers, fax machines, and devices combining functions thereof.

In an electro-photographic image forming apparatus, after light is irradiated to a photoconductor charged with a predetermined electric potential to form an electrostatic latent image on a surface of the photoconductor, a developer is fed to the electrostatic latent image, forming a visible image. The visible image, formed on the photoconductor, is transferred to a recording medium directly or by way of an intermediate transfer medium. A visible image transferred to the recording medium is fixed to the recording medium via a fusing device.

Generally, a fusing device includes a heating member to apply heat to the recording medium. The heating member may be an induction heating member. In a fusing device using induction heating, current is applied to an induction coil to generate eddy current in a heating member so that heat emission of the heating member is accomplished via Joule's heat generated by a resistance of the heating member.

SUMMARY

Exemplary embodiments of the present general inventive concept provide an induction heating type fusing device to reduce the size of an induction coil, an image forming apparatus having the same, and a control method thereof.

Additional features and utilities of the invention will be set forth in part in the description which follows and, in part, will be obvious from the description, or may be learned by practice of the invention.

Exemplary embodiments of the present general inventive concept provide a fusing device that includes a heating member having a main heater and a sub heater and arranged to transfer heat to a recording medium, and an induction coil having a width equal to or less than a width of the recording medium and arranged in an axial direction of the heating member to generate a magnetic field acting on the main heater, wherein the sub heater is arranged inside the heating member to heat both ends of the main heater.

The induction coil may have a width equal to or less than a width of the recording medium that has a maximum size to be accommodated in the fusing device.

The fusing device may further include a main power unit and a sub power unit to supply power to the heating member, the main power unit may supply power to the main heater or the sub heater, and the sub power unit may supply power to the sub heater.

The sub power unit may include a capacitor, and the power output from the main power unit may be charged into the capacitor.

Exemplary embodiments of the present general inventive concept may also provide an image forming apparatus that includes a printing device to form an image on a recording medium, and a fusing device to fix the image to the recording medium, wherein the fusing device includes a heating member arranged in a rotatable manner to transfer heat to the recording medium and having a main heater and a sub heater, and an induction coil having a width equal to or less than a width of the recording medium and arranged in an axial direction of the heating member to generate a magnetic field acting on the main heater, and wherein the sub heater is arranged inside the heating member to heat both ends of the main heater.

The induction coil may have a width equal to or less than a width of the recording medium that has a maximum size to be accommodated in the fusing device.

The fusing device may further include a main power unit and a sub power unit to supply power to the heating member, the main power unit may supply power to the main heater or the sub heater, and the sub power unit may supply power to the sub heater.

The sub power unit may include a capacitor, and the power output from the main power unit may be charged into the capacitor.

Exemplary embodiments of the present general inventive concept may also provide a control method of an image forming apparatus including a fusing device including a main power unit and a sub power unit to supply power, an induction coil to generate a magnetic field upon receiving the power, and a sub heater to generate heat using the power and a main heater to generate heat using the magnetic field, the control method includes driving the induction coil using power output from the main power unit and driving the sub heater using power output from the sub power unit for a predetermined time when a printing implementation command is received by the image forming apparatus, and driving both the induction coil and the sub heater using the power output from the main power unit after the predetermined time passes, to increase a temperature of the main heater.

The sub power unit may include a capacitor and may be charged with the power output from the main power unit upon supply of initial power.

The induction coil provided in the fusing device may have a width equal to or less than a width of the recording medium that has a maximum size to be accommodated in the image forming apparatus, and the power applied to the induction coil may be cutoff if a temperature of the main heater reaches a preset temperature.

The sub heater may be arranged to heat both ends of the main heater, and the power applied to the sub heater may be cutoff if a temperature of both the ends of the main heater reaches a preset temperature.

Exemplary embodiments of the present general inventive concept also provide a method of fixing a developer image onto a recording medium in an image forming apparatus having a heating member and an induction coil, the method including transferring heat from a sub heater to a plurality of sides of a main heater of the heating member to a recording medium to fix the developer image onto the recording medium, and generating a magnetic field to induce an eddy current in the main heater with the induction coil that has a width less than or equal to a width of the recording medium.

The method may also include driving the induction coil using power output from a main power unit of the image forming apparatus, driving the sub heater using power output from a sub power unit of the image forming apparatus for a predetermined time when a printing command is received by the image forming apparatus, and driving both the induction coil and the sub heater using the power output from the main power unit after the predetermined time passes, to increase a temperature of the main heater.

The method may also include charging the sub power unit with power from the main power unit.

The method may also include cutting off the power applied to the induction coil when a temperature of the main heater reaches a predetermined temperature, and cutting off the power applied to the sub heater when a temperature of the main heater reaches a predetermined temperature.

The method may also include receiving temperature information from temperature sensors disposed at a center and a plurality of sides of the main heater, and controlling the sub heater to maintain a predetermined temperature range of the main heater.

The method may also include driving the induction coil when the received temperature information for the plurality of sides is less than the predetermined temperature range.

The method may also include that when the temperature of the plurality of sides decreases below a predetermined temperature, driving the sub heater to maintain the predetermined temperature range of the center and the plurality of sides of the main heater.

BRIEF DESCRIPTION OF THE DRAWINGS

These and/or other utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
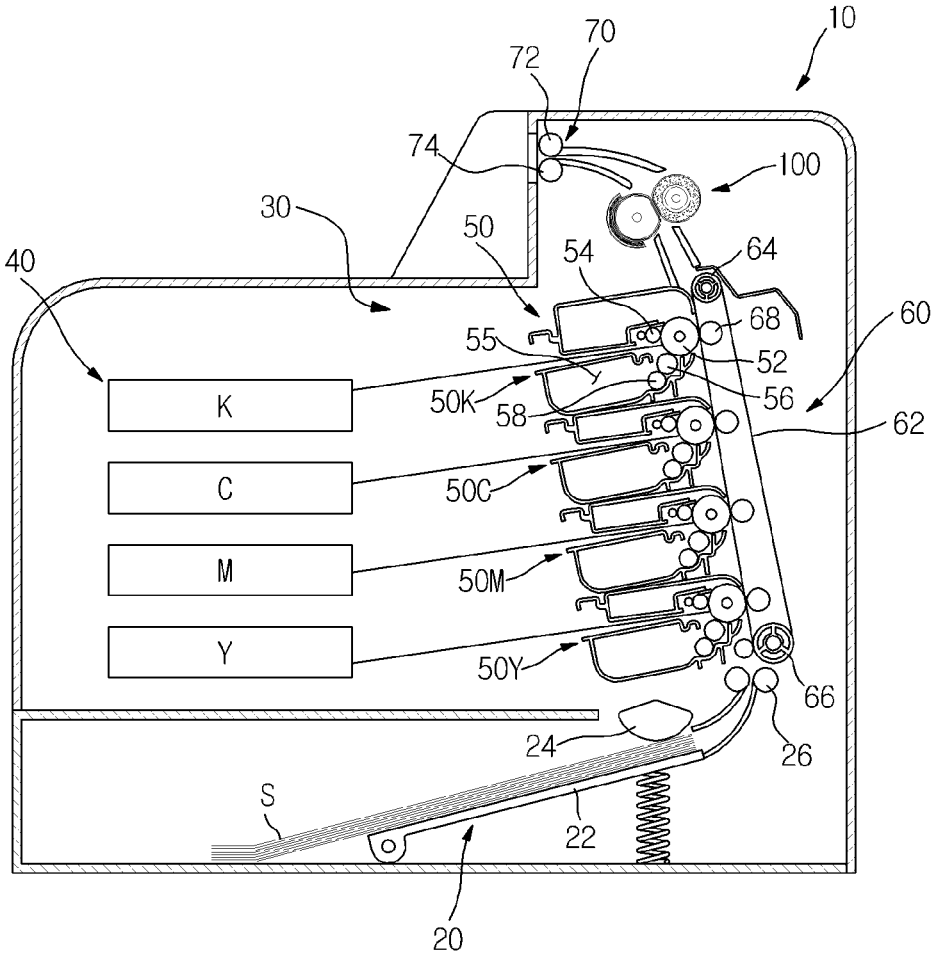
FIG. 1 is a schematic view illustrating an electro-photographic image forming apparatus according to exemplary embodiments of the present general inventive concept.

Reference will now be made in detail to the embodiments of the present invention, examples of which are illustrated in the accompanying drawings, wherein like reference numerals refer to like elements throughout. The embodiments are described below in order to explain the present general inventive concept by referring to the figures.

FIG. 1 is a schematic view illustrating an electro-photographic image forming apparatus according to exemplary embodiments of the present general inventive concept.

As illustrated in FIG. 1, the image forming apparatus 1 can include a body 10, a recording medium supply device 20, a printing device 30, a fusing device 100, and a recording medium discharge device 70.

The body 10 can define an external appearance of the image forming apparatus 1 and can support a plurality of elements installed therein. The body 10 can include a cover (not illustrated) to open or close a part of the body 10, and a body frame (not illustrated) to support or fix the plurality of elements inside the body 10.

The recording medium supply device 20 can supply a recording medium S to the printing device 30. The recording medium supply device 20 can include a tray 22 on which the recording medium S is loaded, and a pickup roller 24 to pick up the recording medium S loaded on the tray 22 sheet by sheet. The recording medium S picked up by the pickup roller 24 can be fed to the printing device 30 by a feed roller 26.

The printing device 30 may include a light scanning device 40, a developing device 50, and a transfer device 60.

The light scanning device 40 can include a scanning optical system (not illustrated) to scan light corresponding to Yellow ('Y'), Magenta ('M'), Cyan ('C'), and Black ('K') image information to the developing device 50 according to a print signal received by the image forming apparatus 1.

The developing device 50 can form a visible image on a photoconductor 52 according to image information received by the image forming apparatus 1 from an external appliance, such as a computer, that is communicatively coupled to the image forming apparatus 1. In exemplary embodiments of the present general inventive concept, the image forming apparatus 1 can be a color image forming apparatus, and the developing device 50 can include four developing units 50Y, 50M, 50C, and 50K, in which different colors of toners, e.g., yellow ('Y'), magenta ('M'), cyan ('C'), and black ('K') toners are received, respectively.

Each of the developing units 50Y, 50M, 50C, and 50K may include the photoconductor 52, a charging roller 54, a developer storage chamber 55, a developing roller 56, and a supply roller 58. The charging roller 54 can charge a surface of the photoconductor 52 with a predetermined electric potential. The light scanning device 40 can scan light to the charged surface of the photoconductor 52, so as to form an electrostatic latent image. The supply roller 58 can supply a developer stored in the developer storage chamber 55 to the developing roller 56, and the developing roller 56 can supply the developer to the electrostatic latent image formed on the photoconductor 52 to form a visible image.

The transfer device 60 can transfer the visible image formed on the photoconductor 52 to the recording medium S. The transfer device 60 can include a transfer belt 62 to circulate when in contact with the respective photoconductors 52, a transfer belt driving roller 64 to drive the transfer belt 62, a tension roller 66 to maintain tension of the transfer belt 62, and four transfer rollers 68 to transfer the visible images formed on the respective photoconductors 52 to the recording medium S.

The recording medium S can be adhered to the transfer belt 62 and can be fed at the same traveling velocity as the transfer belt 62. In this case, a voltage having a polarity opposite to that of the developer attached to the photoconductor 52 can be applied to the transfer roller 68 such that the developer image on the photoconductor 52 can be transferred to the recording medium S.

When the developer image is transferred to the recording medium S by the transfer device 60, the fusing device 100 can fix the developer image to the recording medium S. The fusing device 100 may apply heat to the recording medium S via induction heating. A detailed description related to the fusing device 100 will be described hereinafter.

The recording medium discharge device 70 can discharge the recording medium S out of the body 10. The recording medium discharge device 70 can include a discharge roller 72 and a pinch roller 74 facing each other.

Figure 2:
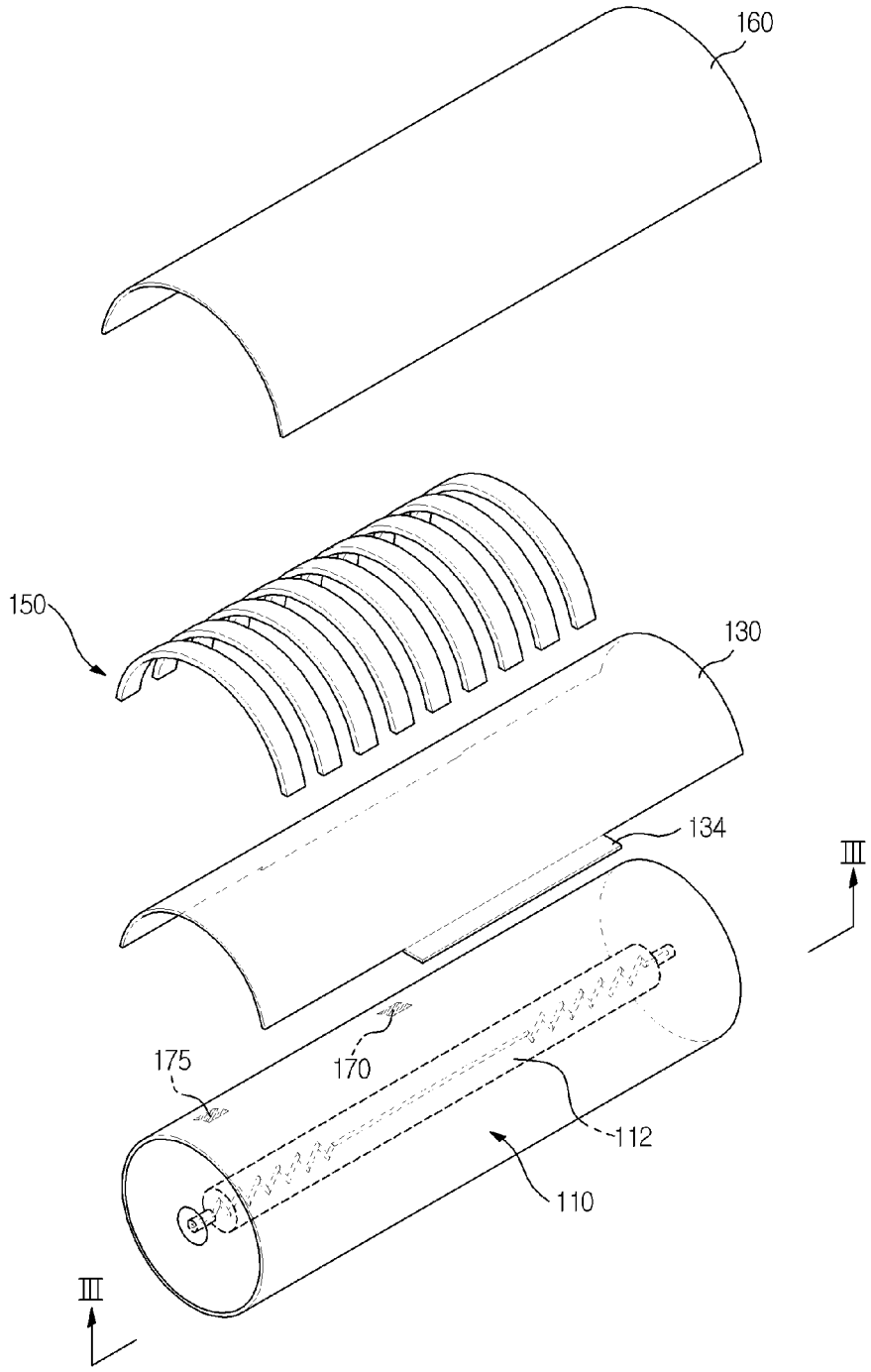
FIG. 2 is a perspective view illustrating a fusing device according to exemplary embodiments of the present general inventive concept.
Figure 3:
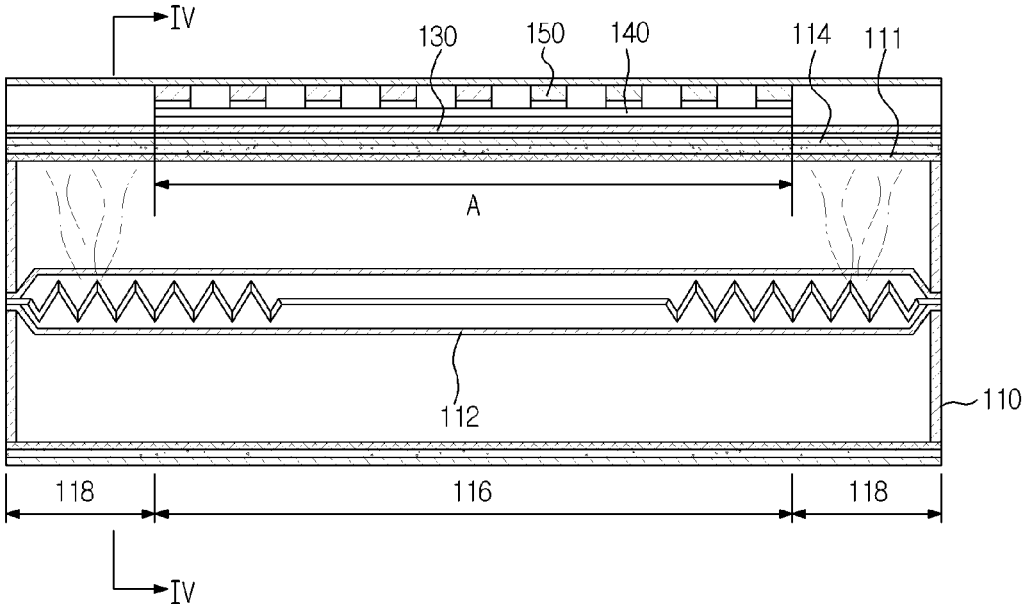
FIG. 3 is a sectional view taken along the line III-III of FIG. 2.
Figure 4:
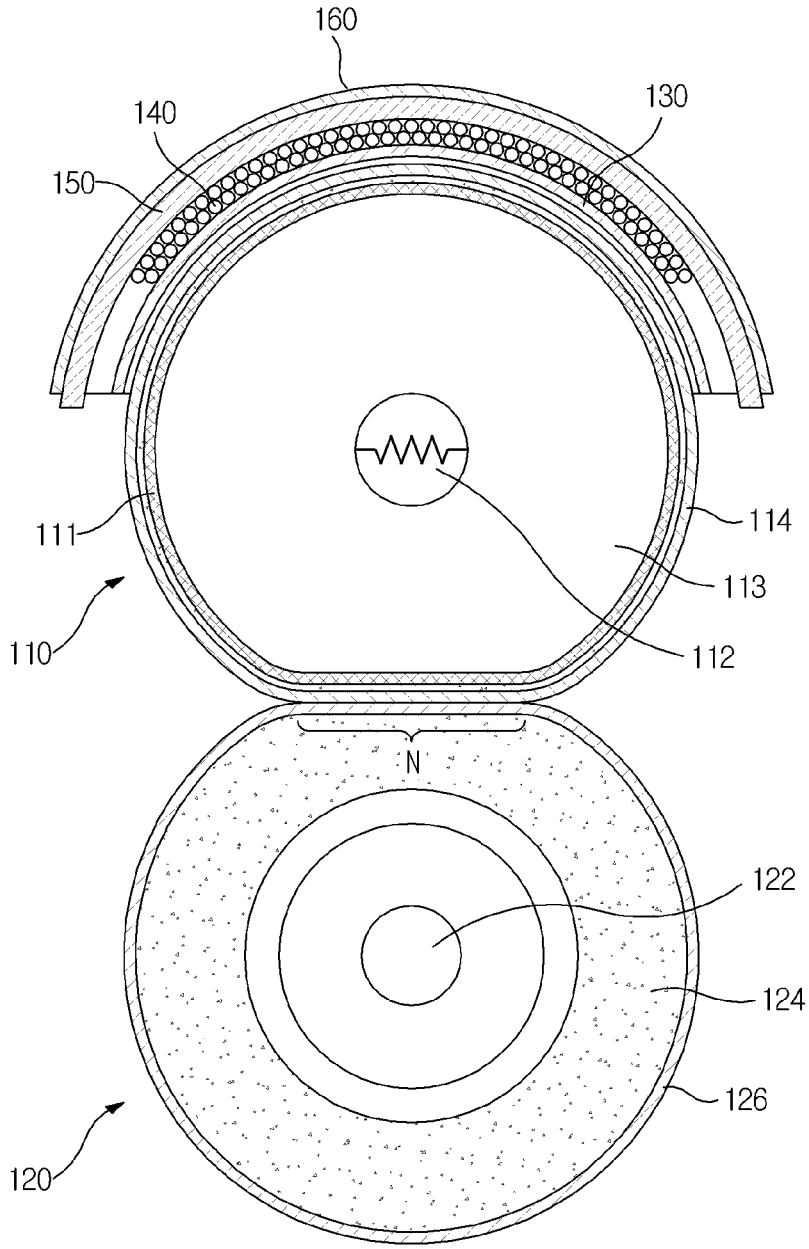
FIG. 4 is a sectional view taken along the line IV-IV of FIG. 3.

FIG. 2 is a perspective view illustrating a fusing device according to exemplary embodiments of the present general inventive concept, FIG. 3 is a sectional view taken along the line III-III of FIG. 2, and FIG. 4 is a sectional view taken along the line IV-IV of FIG. 3. In FIG. 2, illustration of an induction coil and a pressure member is omitted. The pressure member is illustrated in FIG. 4.

The fusing device 100 can include a heating member 110, a pressure member 120, an inductor cover 130, an induction coil 140, and a magnetic flux shielding unit 150.

As the recording medium S, to which the image has been transferred, passes between the heating member 110 and the pressure member 120, the image can be fixed to the recording medium S by heat and pressure.

As illustrated in FIG. 4, the pressure member 120 can be arranged to come into contact with an outer circumferential surface of the heating member 110 so that a fusing nip N is defined between the pressure member 120 and the heating member 110. As a press device (not illustrated) elastically pushes the pressure member 120 toward the heating member 110, the pressure member 120 may come into contact with the heating member 110.

The pressure member 120 may be a roller or any other suitable member to carry out the exemplary embodiments of the present general inventive concept disclosed herein. The pressure member 120 can include a shaft 122 made of metal, such as aluminum or steel, and an elastic layer 124 surrounding the shaft 122. The elastic layer 124 can be made of silicon rubber. A release layer 126 can be provided on a surface of the elastic layer 124 to minimize and/or prevent the recording medium S from adhering to the pressure member 120.

The heating member 110 can include a main heater 111 and can be arranged to transmit heat to the recording medium S passing through the fusing nip N. In addition, the heating member 110 can include a sub heater 112 to heat both ends of the main heater 111. The heating member 110 may take the form of a roller having a release layer 114.

The main heater 111 can be arranged close to the outer circumferential surface of the heating member 110, so as to effectively transmit heat to the recording medium S. The main heater 111 may be made of a conductive material such as metal. The main heater 111 can include temperature sensors 170 and 175 to measure temperatures of the center and both sides of the main heater 111.

The sub heater 112 can be arranged inside the heating member 110, so as to heat both the ends of the main heater 111. The sub heater 112 may be a lamp, a ceramic heater, a surface-heating member, or the like. The heating member 110 can include a thermal layer 113 disposed so as to surround the sub heater 112, and where the main heater 111 is disposed so as to surround the thermal layer 113. The thermal layer 113 can be formed of a material to conduct the heat generated from the sub heater 112 to the main heater 111 so as to heat the ends of the main heater 111.

As illustrated in FIGS. 3 and 4, the induction coil 140 can be arranged close (e.g., at a predetermined distance) to the outer circumferential surface of the heating member 110, so as to generate a magnetic field acting on the main heater 111. The induction coil 140 may be a Litz wire formed by twisting a number of fine copper wires each coated with an insulating layer.

If predetermined alternating current is applied to the induction coil 140 via a power supply circuit (not illustrated), a magnetic field can be generated around the induction coil 140, such that an induction current can be generated in the main heater 111 of the heating member 110. The main heater 111 may emit heat corresponding to the induction current owing to a specific resistance thereof.

The inductor cover 130 can be arranged between the heating member 110 and the induction coil 140. The inductor cover 130 can cover the outer surface of the heating member 110 in an axial direction of the heating member 110. Alternatively, the inductor cover 130 may be arranged in a circumferential direction of the heating member 110 to cover at least a part of the heating member 110, and may be curved along the outer circumferential surface of the heating member 110. Protrusion 134 can be affixed and/or formed on one end of the inductor cover 130. The magnetic flux shielding unit 150 may be disposed on the inductor cover 130, and the outer cover 160 may be disposed on at least a portion of the magnetic flux shielding unit 150 and the inductor cover 130. At least one end of the magnetic flux shielding unit 150 and the outer cover 160 may be disposed so as to contact the protrusion 134 of the inductor cover 130. That is, the protrusion 134 of the inductor cover 130 may be used arrange the magnetic flux shielding unit 150 and the outer cover 160 in a predetermined position on the inductor cover 130.

The inductor cover 130 can minimize and/or prevent heat emitted from the heating member 110 from being directly transmitted to the induction coil 140 or the magnetic flux shielding unit 150. The inductor cover 130 may be made of a material having a predetermined heat-resistance, thermal-insulation, and electric-insulation.

The magnetic flux shielding unit 150 can be arranged around the induction coil 140, to concentrate the magnetic field generated by the induction coil 140 to the main heater 111 of the heating member 110. The magnetic flux shielding unit 150 may include a plurality of magnetic elements arranged in the axial direction of the heating member 110. The magnetic elements may be made of a material selected from the group consisting of iron, nickel, cobalt, and alloys thereof, or may be made of a ferrite material including iron oxide, manganese oxide, zinc oxide, etc.

An outer cover 160 can be provided around the magnetic flux shielding unit 150. The magnetic flux shielding unit 150 may be fixed to the outer cover 160. The outer cover 160 can be installed to cover the magnetic flux shielding unit 150, the induction coil 140 and the inductor cover 130 arranged inside thereof.

As illustrated in FIG. 3, the outer surface of the heating member 110 can include a first region 116 centrally located in the axial direction of the heating member 110 and second regions 118 located at opposite sides of the first region 116 in the axial direction of the heating member 110. The first region 116 can have a size corresponding to that of the recording medium S under the assumption that the recording medium S has a maximum size selected from among various sizes of recording media that may be accommodated in the image forming apparatus 1.

More specifically, the recording medium S of a maximum size (e.g., a letter sheet) can pass through the fusing nip N, the first region 116 can come into contact with the recording medium S, whereas the second regions 118 do not come into contact with the recording medium S. In the fusing device 100 in which the main heater 111 emits heat via induction heating using the induction coil 140, one side or both sides of the main heater 111 may have a lower temperature than the center of the main heater 111 when the induction coil 140 is short. When this occurs, the developer image may not fix to both sides of the recording medium S.

Conventionally, the induction coil 140 has been fabricated to have a greater width than that of the recording medium S so as to minimize and/or prevent deterioration in the temperature of both sides of the heating member 110 that come into contact with both sides of the recording medium S. However, this conventional method causes an increase in the overall width of the magnetic flux shielding unit 150 due to the increased width of the induction coil 140, resulting in difficulty in size reduction of the fusing device and increasing manufacturing costs of the fusing device. In exemplary embodiments of the present general inventive concept of the present invention, the induction coil 140 may have a width equal to or less than a width of the recording medium S that has a maximum size to be accommodated in the image forming apparatus 1. To minimize and/or prevent deterioration in the temperature of both sides of the heating member 110 due to the reduced width of the induction coil 140, the sub heater 112 may be arranged inside the heating member 110 to heat both the ends of the main heater 111. Referring to FIG. 3, the width A of the induction coil 140 can be equal to the first region 116, and the sub heater 112 can be installed inside the heating member 110 to heat one or both the ends of the main heater 111. Although FIG. 3 illustrates the width A of the induction coil 140 as being equal to the first region 116, according to exemplary embodiments of the present general inventive concept, the width A of the induction coil 140 may be less than the first region 116. In exemplary embodiments of the present general inventive concept, the width A of the induction coil 140 may be less than a width of an induction coil that has been conventionally installed in an induction heating type image forming apparatus, but may be slightly greater than the first region 116 corresponding to the width of the recording medium S that has a predetermined maximum size to be accommodated in the image forming apparatus 1.

Hereinafter, a control circuit of the heating member 110 including the sub heater 112 will be described.

Figure 5:
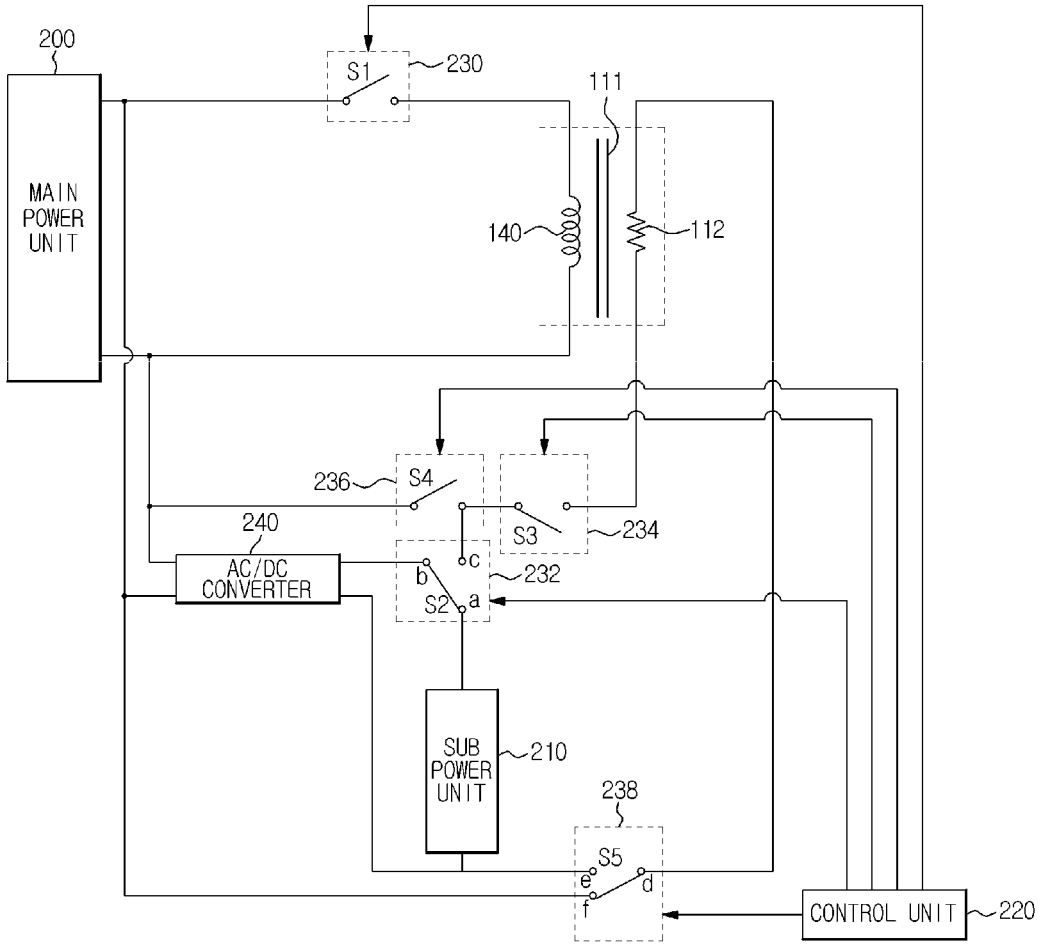
FIG. 5 illustrates a control circuit of a heating member according to exemplary embodiments of the present general inventive concept.

FIG. 5 is a control circuit diagram of the heating member according to exemplary embodiments of the present general inventive concept.

A main power unit 200 can be connected to a power source of AC 110V (or 220V) and can adjust a voltage before supplying it to the induction coil 140 and the sub heater 112. A sub power unit 210 can include a large-capacity condenser that can be charged and/or discharged. The capacity and number of the condenser can be determined according to electric energy supplied to the sub heater 112.

A control unit 220 can control switching operation of a first switch 230 to supply current from the main power unit 200 to the induction coil 140. When power is initially turned on, the sub power unit 210 can be charged with power under the control of the control unit 220 as will be described hereinafter. When a print command is received, the control unit 220 can switch on the first switch 230 to connect the main power unit 200 to the induction coil 140 when the sub power unit 210 has received a power charge. When the main power unit 200 is connected to the induction coil 140 via switching of the first switch 230, the main power unit 200 can supply current to the induction coil 140 to generate a magnetic field and, consequently, generate an eddy current in the main heater 111. As the eddy current is applied to the resistance of the main heater 111, Joule's heat can be generated.

The control unit 220 can control switching operation of a second switch 232 to charge the condenser of the sub power unit 210 with power supplied from the main power unit 200. An AC voltage supplied from the main power unit 200 can be converted into a DC voltage via an AC/DC converter 240. The condenser of the sub power unit 210 can be charged with the converted DC voltage. The second switch 232 can be switched on when power is initially turned on to connect an end "a" of the sub power unit 210 to an end "b" of the AC/DC converter 240. When a power charge of the condenser of the sub power unit 210 is completed, the end "a" of the sub power unit 210 can be connected to an end "c" of the sub heater 112.

The control unit 220 can control a switching of a third switch 234 to apply power that is supplied from the main power unit 200 or the sub power unit 210 to the sub heater 112. The sub heater 112 can generate heat upon receiving the power supplied from the main power unit 200 or the sub power unit 210. The heat generated from the sub heater 112 can heat one or both the ends of the main heater 111. The third switch 234 can release a connection between the main power unit 200 or the sub power unit 210 and the sub heater 112 when both the ends of the main heater 111 reach a preset temperature.

The control unit 220 can control a switching of a fourth switch 236 to apply power supplied from the main power unit 220 to the sub heater 112. The control unit 220 can control switching the fourth switch 236 in synchronization with switching the second switch 232. When the fourth switch 236 is switched to connect the main power unit 200 to the sub heater 112, the second switch 232 can release a connection between the sub power unit 210 and the sub heater 112. However, since a fifth switch 238 defines a closed circuit as will be described hereinafter, it may not be necessary to synchronize the switching operation of the fourth switch 236 with the switching operation of the second switch 232.

The control unit 220 can control a switching of the fifth switch 238 to synchronize the switching of the fifth switch 238 with the switching of the second and fourth switches 232 and 236. When the second switch 232 connects the end "a" of the sub power unit 210 to the end "c" of the sub heater 112, the fifth switch 238 may connect the other disconnected end "e" of the sub power unit 210 to the other disconnected end "d" of the sub heater 112 to form a closed circuit. Also, when the fourth switch 236 is switched on to connect the main power unit 200 to the sub heater 112, the fifth switch 238 may connect the other disconnected end "f" of the main power unit 200 to the other disconnected end "d" of the sub heater 112 so as to define a closed circuit.

Figure 6:
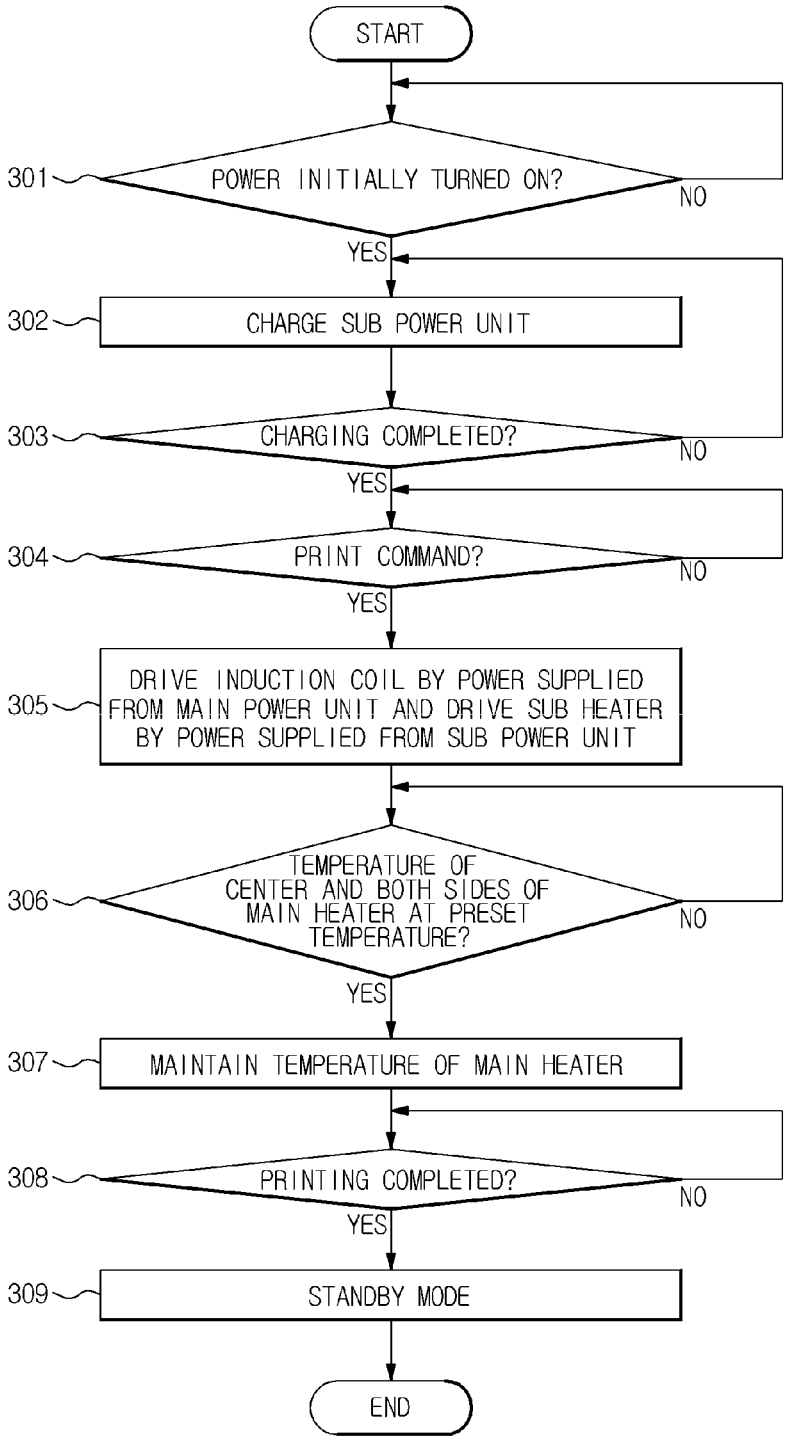
FIG. 6 illustrates a control flow chart of a heating member included in an image forming apparatus according to exemplary embodiments of the present general inventive concept.

FIG. 6 illustrates a control flow chart of the heating member included in the image forming apparatus according to exemplary embodiments of the present general inventive concept.

At operation 301, it is determined whether the power is initially turned on. As illustrated in FIG. 6, the control unit 220 can power charge the sub power unit 210 when power is initially turned on. The main power unit 200 can supply power to charge the condenser of the sub power unit 210. An AC voltage supplied from the main power unit 200 can be converted into a DC voltage via the AC/DC converter 240, and the condenser of the sub power unit 210 can be charged with the converted DC voltage at operation 302.

At operation 303, it is determined whether the condenser of the sub power unit 210 has been charged. If it is determined that the charging the sub power unit 210 has not been completed, the sub power unit 210 can be charged at operation 302. When a complete power charge of the condenser of the sub power unit 210 has been confirmed at operation 303, the control unit 220 can confirm whether or not a print command input has been received at operation 304. If the print command has been received, the control unit 220 can control power supplied from the main power unit 200 and the sub power unit 210 to drive the induction coil 140 and the sub heater 112 at operation 305. More specifically, the main power unit 200 can supply current to the induction coil 140 to generate an eddy current, so that the eddy current can be applied to the resistance of the main heater 111 to generate Joule's heat. The sub power unit 210 can supply current to the sub heater 112 to generate heat so as to heat both the ends of the main heater 111.

The control unit 220 can receive temperature information from the temperature sensors 170 and 175 installed at the center and both sides of the main heater 111. If it is determined at operation 306 that temperatures of the center and both sides of the main heater 111 reach preset temperature ranges (for example, the temperature of the center is in a range of 170~190° C. and the temperature of both sides is in a range of 160~170° C.), the sub heater 111 is controlled to maintain the above temperatures at operation 306. If the temperature of the center of the main heater 111 decreases below a preset temperature, the control unit 220 can drive the induction coil 140. If the temperature of both sides of the main heater 111 decreases below a preset temperature, the control unit 220 can drive the sub heater 112 to maintain the temperatures of the center and both sides of the main heater 111 in the above preset temperature ranges.

At operation 308, the control unit 220 can confirm whether or not a print operation is completed. If completion of the print operation is confirmed, the control unit 220 can begin a standby mode at operation 309. In the standby mode, the driving of the induction coil 140 and the sub heater 112 is stopped until a next print command is received.

Figure 7:
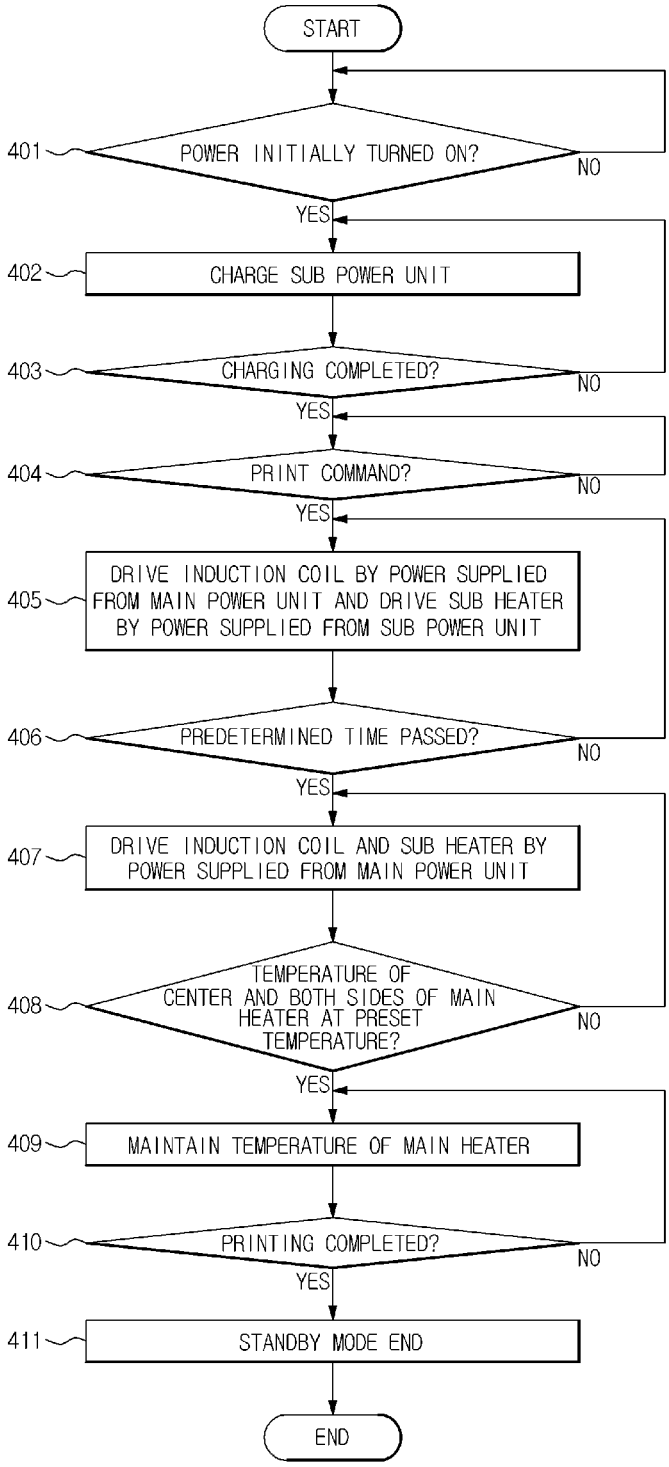
FIG. 7 illustrates a control flow chart of a fusing device according to exemplary embodiments of the present general inventive concept.

FIG. 7 illustrates a control flow chart of the fusing device according to exemplary embodiments of the present general inventive concept.

Operations 401 to 405 of FIG. 7 are identical to operations 301 to 305 of FIG. 6 and thus, a description thereof is substituted by the above description of FIG. 6. In the exemplary embodiments of the present general inventive concept illustrated in FIG. 7, both the main heater 111 and the sub heater 112 are driven by power supplied from the main power unit 200 when a predetermined time passes after a print operation begins.

The induction coil 140 can be driven by power supplied by the main power unit 200 and the sub heater 112 can be driven by power supplied by the sub power unit 210 in operation 405. If it is determined at operation 406 that a predetermined time passes after the induction coil 140 and the sub heater 112 are driven, both the induction coil 140 and the sub heater 112 can be driven by power supplied by the main power unit 200 at operation 407. Specifically, supply of power from the sub power unit 210 can be cutoff, and only the main power unit 200 supplies power to drive the induction coil 140 and the sub heater 112.

When the heating member 110 initially performs a heating operation, a flicker phenomenon can occur as both the induction coil 140 and the sub heater 112 are driven by power supplied by the main power unit 200. For example, assuming that power rating of the image forming apparatus 1 is 1,300 w, power to initially drive the induction coil 140 is 1,300 w and power to initially drive the sub heater 112 is 300 w, if the main power unit 200 attempts to supply power to both the induction coil 140 and the sub heater 112 upon initial driving of the heating member 110, the main power unit 200 may need 1,600 w (e.g., 1,300 w+300 w), which may exceed the predetermined power rating of the image forming apparatus 1. To provide the main power unit 200 connected to a power source with the power exceeding the power rating of the image forming apparatus 1, other peripheral electronic devices connected to the power source may undergo hindrance in power supply and thus, may flicker. This is called a flicker phenomenon.

Accordingly, in exemplary embodiments of the present general inventive concept, instead of the main power unit 200 supplying power to both the induction coil 140 and the sub heater 112 upon initial driving of the heating member 110, the main power unit 200 can supply power to the induction coil 140 and the sub power unit 210 by using the power charged in the condenser to supply power to the sub heater 112, whereby large quantities of power may be provided without a supply of power exceeding power rating from a power source.

When a predetermined time passes after initial driving of the heating member 110, the main heater 111 may request reduced power. Accordingly, when a predetermined time passes after initial driving of the heating member 110, the control unit 220 may drive both the induction coil 140 and the sub heater 112 by using the power supplied from the main power unit 220, and may charge the sub power unit 210 with surplus power within a predetermined power rating, except for the power supplied from the main power unit 200 to the induction coil 140 and the sub heater 112.

The control unit 220 can receive temperature information from the temperature sensors 170 and 175 installed at the center and both sides of the main heater 111. If it is determined at operation 408 that the temperatures of the center and both sides of the main heater 111 reach the preset temperature ranges (for example, the temperature of the center is in a range of 170~190° C. and the temperature of both sides is in a range of 160~170° C.), the control unit 220 can maintain the temperatures of the main heater 111 at operation 409. If the temperature of the center of the main heater 111 decreases below a preset temperature, the induction coil 140 can be driven to generate heat from the main heater 111. When the temperature of both sides of the main heater 111 decreases below a preset temperature, the sub heater 112 can be driven to heat both the ends of the main heater 111.

At operation 410, the control unit 220 confirms whether or not the print operation is completed. If completion of the print operation is confirmed, the control unit 220 begins a standby mode at operation 411. In the standby mode, driving of both the induction coil 140 and the sub heater 112 is stopped until a next print command is received.

As apparent from the above description, according to exemplary embodiments of the present general inventive concept, a sub heater to heat both ends of a main heater is arranged inside a heating member to reduce a magnitude of an induction coil that generates heat by inducing eddy current in the main heater.

According to exemplary embodiments of the present general inventive concept, a main power unit connected to a power source and a sub power unit, in which power is previously charged in a capacitor, can simultaneously supply power to the heating member when power of a fusing device is initially turned on, such that predetermined amounts of power can be provided to the fusing device.

Although several embodiments of the present general inventive concept have been illustrated and described, it would be appreciated by those skilled in the art that changes may be made in these embodiments without departing from the principles and spirit of the general inventive concept, the scope of which is defined in the claims and their equivalents.

What is claimed is:

1. A fusing device comprising:

a heating member having a main heater and a sub heater and arranged to transfer heat to a recording medium; and an induction coil having a width equal to or less than a width of the recording medium and arranged in an axial direction of the heating member to generate a magnetic field acting on the main heater, wherein the sub heater is arranged inside the heating member to heat both ends of the main heater.

2. The fusing device according to claim 1, wherein the induction coil has a width equal to or less than a width of the recording medium that has a maximum size to be accommodated in the fusing device.

3. The fusing device according to claim 1, further comprising:

a main power unit and a sub power unit to supply power to the heating member, wherein the main power unit supplies power to the main heater or the sub heater, and the sub power unit supplies power to the sub heater.

4. The fusing device according to claim 3, wherein:

the sub power unit includes a capacitor; and the power output from the main power unit is charged into the capacitor.

5. An image forming apparatus comprising:

a printing device to form an image on a recording medium; and a fusing device to fix the image to the recording medium, wherein the fusing device includes:

a heating member arranged in a rotatable manner to transfer heat to the recording medium and having a main heater and a sub heater; and an induction coil having a width equal to or less than a width of the recording medium and arranged in an axial direction of the heating member to generate a magnetic field acting on the main heater, and wherein the sub heater is arranged inside the heating member to heat both ends of the main heater.

6. The image forming apparatus according to claim 5, wherein the induction coil has a width equal to or less than a width of the recording medium that has a maximum size to be accommodated in the fusing device.

7. The image forming apparatus according to claim 5, wherein:

the fusing device further includes a main power unit and a sub power unit to supply power to the heating member, the main power unit supplies power to the main heater or the sub heater, and the sub power unit supplies power to the sub heater.

8. The image forming apparatus according to claim 7, wherein:

the sub power unit includes a capacitor; and the power output from the main power unit is charged into the capacitor.

9. A control method of an image forming apparatus comprising a fusing device including a main power unit and a sub power unit to supply power, an induction coil to generate a magnetic field upon receiving the power, and a sub heater to generate heat using the power and a main heater to generate heat using the magnetic field, the control method comprising:

driving the induction coil using power output from the main power unit and driving the sub heater using power output from the sub power unit for a predetermined time when a printing command is received by the image forming apparatus; and driving both the induction coil and the sub heater using the power output from the main power unit after the predetermined time passes, to increase a temperature of the main heater.

10. The control method according to claim 9, wherein the sub power unit includes a capacitor and is charged with the power output from the main power unit upon supply of initial power.

11. The control method according to claim 9, wherein:

the induction coil provided in the fusing device has a width equal to or less than a width of the recording medium that has a maximum size to be accommodated in the image forming apparatus; and the power applied to the induction coil is cutoff if a temperature of the main heater reaches a preset temperature.

12. The control method according to claim 9, wherein:

the sub heater is arranged to heat both ends of the main heater; and the power applied to the sub heater is cutoff if a temperature of both the ends of the main heater reaches a preset temperature.

* * * * *